United States Patent [19]

MacAskill et al.

[11] Patent Number: 4,509,904

[45] Date of Patent: Apr. 9, 1985

[54] METERING PUMP

[75] Inventors: Christopher R. MacAskill, Sunnyvale; Jared M. Potter, Mountain View, both of Calif.

[73] Assignee: Petrophysical Services, Inc., Mountain View, Calif.

[21] Appl. No.: 538,774

[22] Filed: Oct. 4, 1983

[51] Int. Cl.[3] ..... F04B 21/02; F04B 39/10

[52] U.S. Cl. ..... 417/568; 74/640

[58] Field of Search ..... 417/559-571; 74/640

[56] References Cited

U.S. PATENT DOCUMENTS

| | | | |
|---|---|---|---|
| 2,943,508 | 7/1960 | Musser | 74/640 |
| 2,979,964 | 4/1961 | Musser | 74/640 |
| 3,199,341 | 8/1965 | Heuer, Jr. et al. | 73/94 |
| 3,208,388 | 9/1965 | Glasgow | 103/57 |
| 3,214,999 | 11/1965 | Lapp | 74/640 |
| 3,397,643 | 8/1968 | Jepsen | 103/46 |
| 3,556,679 | 1/1971 | Middlebusher et al. | 417/63 |
| 3,653,787 | 4/1972 | Commarmot | 417/415 |
| 3,775,025 | 11/1983 | Maher, Jr. et al. | 417/7 |
| 3,814,541 | 6/1974 | Dent et al. | 417/7 |
| 3,847,507 | 11/1974 | Sakiyama et al. | 417/22 |
| 3,860,968 | 1/1975 | Shapiro | 417/384 |
| 4,255,096 | 3/1981 | Coker, Jr. et al. | 417/415 |
| 4,276,003 | 6/1981 | Perkins et al. | 417/415 |
| 4,304,527 | 12/1981 | Jewell et al. | 417/102 |
| 4,326,837 | 4/1982 | Gilson et al. | 417/12 |

OTHER PUBLICATIONS

"Harmonic Drive—Principles and Performance", United Shoe Machinery Corp., 1959.

Musser, "The Harmonic Drive", *Machine Design,* reprint, United Shoe Machinery Corp., 1960.

*Primary Examiner*—Carlton R. Croyle
*Assistant Examiner*—Donald E. Stout
*Attorney, Agent, or Firm*—Hubbard and Stetina

[57] ABSTRACT

A high precision, high pressure, volumetric metering pump in which the driving motor is reciprocated by rotation of a ball screw, the drive motor assembly being integral with the driving and pumping shaft, is disclosed.

2 Claims, 5 Drawing Figures

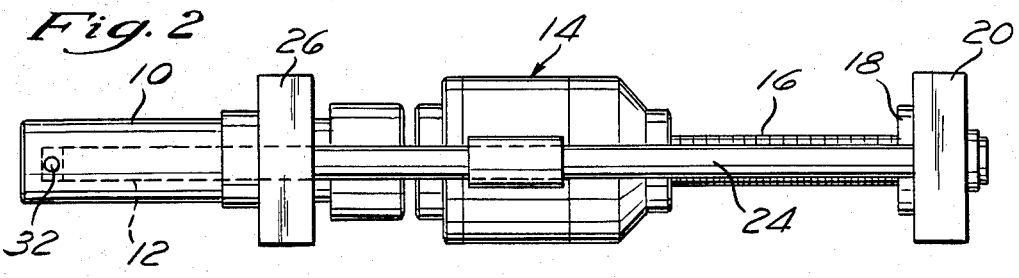
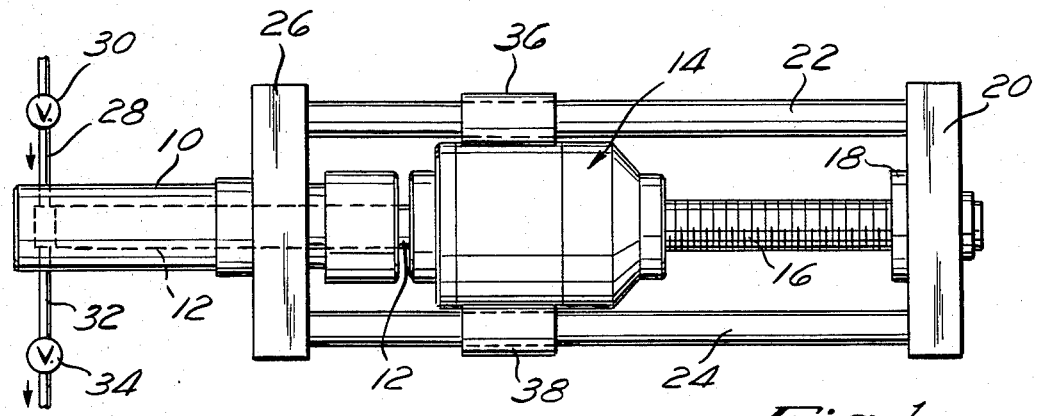
Fig. 1
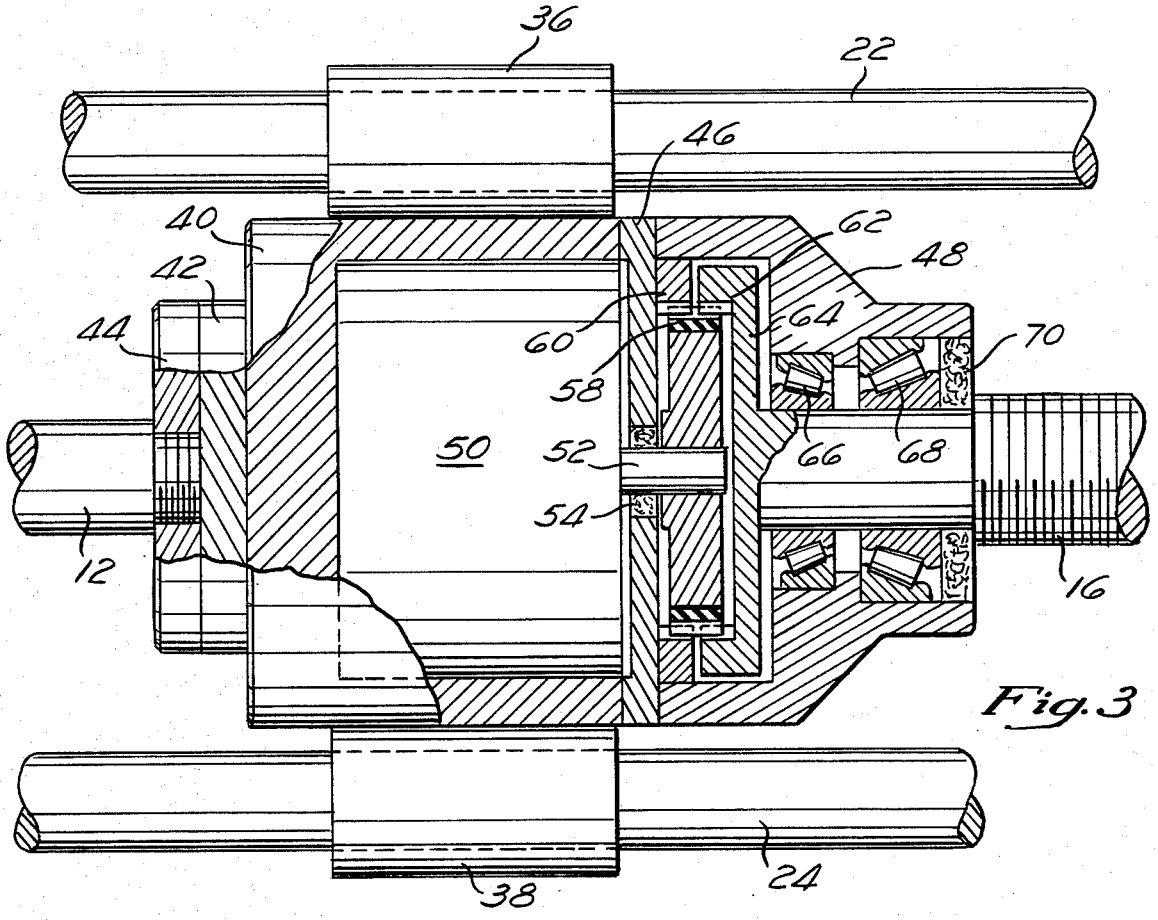
Fig. 3

METERING PUMP

BACKGROUND OF THE INVENTION

In oil production, refining, and treating, it is frequently necessary to meter precisely controlled amounts of additives to feed, process, or output streams. Since these streams are often at very high pressures, it is necessary to meter the input at the same, or greater, high pressures. It becomes very difficult to meter precisely controlled volumes of liquids at high pressures because of the necessity to bring the metered liquid to a precisely controlled pressure at least equal to the pressure of the stream into which it is metered and to maintain that pressure. Serious perturbations and consequent errors typically result in processes using prior art metering pumps.

Prior art metering pumps typically have been extremely heavy devices, very expensive, difficult to handle, and cumbersome in operation. These pumps may, for example, weight many hundreds of pounds and may be extremely difficult to install and to maintain. One reason for the large size of these pumps is that, in an effort to minimize the number of serious pressure perturbations which occurred, large pistons were used so that once the system was at pressure, the additive could be metered out of the piston for a comparatively long period of time before it was necessary to refill the piston or transfer to another metering pump. Large pistons, of course, require very high forces to obtain the desired high pressures. This means that heavy duty support systems, brackets, bearings, drives, etc., are required. Consequently, every component must be heavy and interconnected very solidly. This results in very expensive and cumbersome units.

There have been some efforts to use smaller metering pumps, and some efforts have been made to minimize perturbations in the system. For example, the use of double screw type pumps have been proposed. This involves two pumps for compressing a liquid at a constant speed, by rotating a screw for moving a liquid transferring piston by a pulse motor or servo motor through gears, so that a supply and a suction of the liquid are alternately provided to prevent intervals therebetween. This system, however, requires various techniques and labor for preventing inaccurate timing in the switching process. Thus, even though accurate conformity of the characteristics of the two pumps is provided and accurate simultaneous switching is possible, a pressure fluctuation still results, corresponding to a different coefficient of a change in the room temperature when a solvent having a high thermal expansion coefficient is used. In an effort to overcome these problems, Sakiyama, et al., U.S. Pat. No. 3,847,507, Nov. 12, 1974, provided a system for supporting a liquid by pump when the pressure in a cylinder of the pump is detected and the movement of the piston is controlled by an automatic control circuit having a differential amplifier through an electric motor and feedback signal originated from a tachometer connected to the motor.

The use of screw driven pumps is, of course, well known, and even the low friction ball-screw mechanism has been used in driving pumps. See, for example, U.S. Pat. No. 3,397,643, Jepsen, Aug. 20, 1968, and Glasgow, U.S. Pat. No. 3,208,388, Sept. 28, 1965. Other screw driven metering pumps, some including control mechanisms, are disclosed in U.S. Pat. No. 4,276,003, Perkins, et al., June 30, 1981, U.S. Pat. No. 3,255,096, Coker, Jr., et al., Mar. 10, 1981, and U.S. Pat. No. 3,556,679, Middlebusher, et al., Jan. 19, 1971.

A number of control mechanisms and stepping motor driven pumping systems have also been used. See, for example, U.S. Pat. No. 4,326,837, Gilson, et al., Apr. 27, 1982, U.S. Pat. No. 3,653,787, Commarmot, Apr. 4, 1972, U.S. Pat. No. 4,304,527, Jewell, et al., Dec. 8, 1981, U.S. Pat. No. 3,775,025, Maher, Jr., et al., Nov. 27, 1973, and U.S. Pat. No. 3,814,541, Dent, et al., June 4, 1974.

In the prior art pumps generally, the pumping is accomplished by a cylinder in which a piston reciprocates, thus giving a precise displacement for each stroke, assuming constant pressure. The piston is driven, typically, from an electric motor connected to a screw or cam drive through a complex gearing or chain drive mechanism resulting in a cumbersome, heavy, and often inefficient pumping system.

The present invention has as one of its objects and features, providing a light weight, highly efficient, extremely accurate metering pump in which the drive motor is integral with the piston and drive screw.

SUMMARY OF THE INVENTION

The invention comprises the combination of a unitarily associated piston, drive motor, and drive screw, all of which reciprocate, the piston reciprocating in and out of a cylinder to perform the pumping function while the drive shaft reciprocates, by rotation, in an out of a ball screw which is fixed relative to the cylinder.

Another feature of importance to this invention is the incorporation into the aforementioned system of a highly efficient harmonic gear reducer system.

In a more particular expression, the invention is a coaxially aligned pumping machine comprising the combination of a fixed assembly and a moveable assembly; the fixed assembly comprising in combination at least one support means and a pump cylinder having means to permit inflow and outflow of fluid and a ballscrew, the ballscrew and cylinder being mounted by the support means coaxially with and spaced from each other proximate respective ends of the support means; and the moveable assembly comprising in combination a drive mounted for reciprocal movement on the support means of the fixed assembly, a piston extending in one direction from the drive into the cylinder, the piston and cylinder comprising a pump, and a threaded shaft rotatably driven by the drive selective in two directions of rotation extending in the other direction from the drive through the ballscrew, the cylinder, piston, drive, shaft and ballscrew each having an axis and being coaxially aligned, the moveable assembly being so constructed and configured that when the drive rotates the shaft in one rotational direction the moveable assembly moves in one reciprocal direction and when the drive rotates the shaft in the other rotational direction the moveable assembly moves in the other reciprocal direction to thereby cause the piston to reciprocate in the cylinder to pump fluid into and out of the cylinder.

In the preferred embodiment the drive is an electric drive motor and a harmonic drive gear assembly comprising a fixed/rigid circular spline having gear teeth internally thereof, a moveable rigid circular spline having gear teeth internally thereof, a flexible spline having gear teeth externally thereof for meshing with the internal gear teeth on the fixed and moveable rigid circular splines and a wave generator inside the flexible spline, the wave generator being rotatably driven by the drive motor in contact with the flexible spline for causing gear teeth on portions only of the flexible spline to mesh with portions only of the gear teeth of said rigid splines, said portions of gear teeth moving circularly in the rigid splines as the wave generator is rotatably driven in one rotational direction or the other by the drive motor, the number of gear teeth on the fixed rigid spline being different than the number of gear teeth on the moveable rigid spline.

These and other features will be apparent from the description which follows.

DESCRIPTION OF THE DRAWINGS

FIG. 1 is a top plan view of the overall pump assembly of this invention.

FIG. 2 is a side view of the overall pump assembly of this invention.

FIG. 3 is an enlarged depiction of the drive motor and gear reducer connected to the piston and ball screw shaft of this invention.

DETAILED DESCRIPTION OF THE INVENTION

Figure 5:
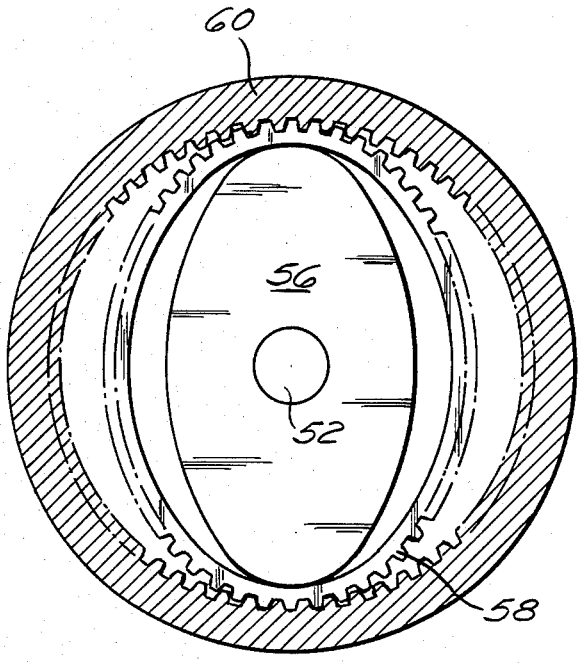
FIG. 5 is the harmonic gear reducer with the wave generator shown oriented 90 degrees from the orientation of the wave generator in FIG. 4.

The invention comprises the assembly of the following components, although variations may be made in each of the components and limited variation may be made in the size and relationship of the particular components.

The invention comprises a pump which includes a cylinder 10 having a piston 12 designed and configured to reciprocate within the cylinder 10 to provide the pumping action. The piston is moved as the drive motor 14 reciprocates, reciprocation resulting from rotation in one direction or the other of a threaded shaft 16 in a ball screw mechanism 18. The ball screw mechanism 18 is mounted in an end plate 20 which is mounted in fixed and spaced relationship by means of support bars 22 and 24 from an end plate 26 which mounts the cylinder. Thus, the ball screw and the cylinder are mounted concentrically with the drive motor 14, all three being located along a common axis.

Pumping is accomplished by means of an input line 28 with a one-way valve 30, which permits inflow to but not outflow from the cylinder, and by an output line 32 and a one-way valve 34, which permits outflow from but not inflow to the cylinder. The drive motor and gear reducer combination 14 is slideably mounted by means of slideable sleeves 36 and 38 on support bars 22 and 24 such that the motor and gear reducer assembly 14 reciprocates between the two plates 20 and 26 providing the pumping action. Reciprocation results from rotation of the threaded shaft 16 in the ball screw mechanism 18. No further description is required of the ball screw, of course, since it is a rather well known mechanism and is described in a number of the prior art patents, see Glasgow, U.S. Pat. No. 3,208,388, for example.

Figure 4:
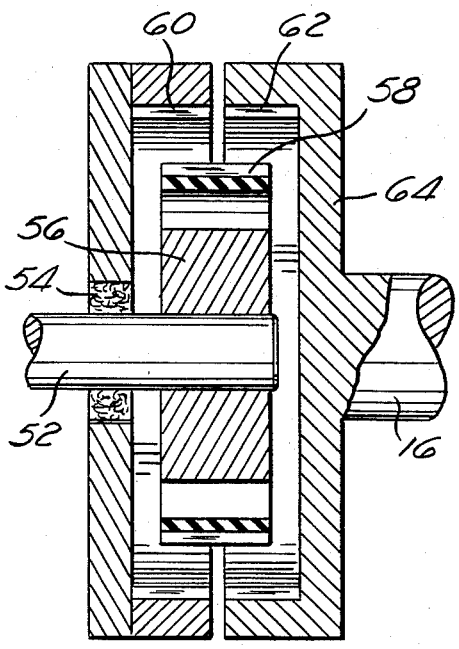
FIG. 4 is an enlarged, side, cross-sectional view of the harmonic gear reducer used in this invention.

Reference is made to FIGS. 3, 4, and 5 for a more detailed depiction of the operation of the drive motor and harmonic gear reducer. The drive motor and gear reducer are associated together as a single unit in a housing comprised of a rear housing section 40, which surrounds the drive motor to which a drive plate 42 and a connector plate 44 are attached for connection to the piston 12. A central plate 46 divides the drive motor chamber from the gear reducer chamber, the latter being defined by the housing section 48. Likewise, the supporting slide cylinders 36 and 38 are secured to the housing in any desirable way. They may be welded, bolted, or clamped, for example, to the housing.

The drive motor 50 is secured in the housing from which a drive shaft 52 extends. The drive shaft 52 is rotatable relative to the housing. The electrical input to the motor is not shown to avoid undue complication of the drawing, but it will be understood that any electrical input and control circuits may be used.

The drive shaft 52 extends through an oil seal 54 into the gear reducer chamber where the shaft is connected to the elliptical wave generator 56. The operation of the harmonic gear reducer is described in detail in HARMONIC DRIVE PRECISION REDUCTION GEARING DESIGNERS MANUAL, published by Harmonic Drive Division, Emhart Machinery Group, 51 Armory Street, Wakefield, MA 01880. A completely detailed description is, therefore, unnecessary here, but the principle of operation will be described along with the structures which permit its operation because of the importance of the integral interconnection of the overall system, including the harmonic gear reduction mechanism. A rigid circular spline 60 is fixed to the plate 46 and, thereby, rigidly fixed to the housing of the drive motor. Another ciruclar spline 62 is mounted on the output drive 64 which, in turn, is secured to the end of the threaded screw shaft 16, the end of which is free of threading and rides in bearings 64 and 66 and extends through an oil seal 70.

The elliptical wave generator 56, the configuration of which is best shown in FIG. 5, drives the flexible spline by pressing the flexible spline, which has externally formed teeth thereon, into teeth internally formed on fixed rigid circular spline 60 and the rotational rigid spline 62 at two points. The rotational circular spline 62 has fewer teeth than the number of teeth on the fixed circular spline 60.

Thus, the harmonic drive gearing employs three concentric components to produce high mechanical advantage and speed reduction. Since the teeth on the non-rigid flexible spline and the rigid circular spline are in continuous engagement and since the flexible spline has two teeth fewer than the circular spline, one revolution of the input causes relative motion between the flexible spline and the circular spline equal to two teeth. Thus, with the circular spline rotationally fixed, the flexible spline will rotate in the opposite direction to the input at a reduction rate equal to the number of the teeth on the flexible spline divided by two. In a suitable example, the rigid circular spline has 545 gear teeth and the flexible spline has 543 gear teeth, giving a gear reduction ratio of 270, approximately. It will be apparent, however, that any desired gear reduction ratio may be achieved using the principles of the harmonic drive gearing.

The invention resides in the unique combination of components which result in a very much lighter, highly efficient, and precisely accurate pump. This high efficiency, light weight design is accomplished by arranging the piston and cylinder, the drive motor, and the ball screw on a single axis, mounting the ball screw and the piston in a fixed relation with respect to each other, mounting the drive motor for reciprocation between the ball screw and the cylinder, and driving the motor to reciprocate the motor, and consequently the piston in the cylinder, by rotating the threaded drive shaft alternately in one direction or another at a controlled either fixed or variable speed, in the ball screw assembly. No similar or comparable pump has been used, to the best of the knowledge of the inventor, in the petroleum industry or in the laboratory. The highly efficient design reduces costs and increases production significantly.

INDUSTRIAL APPLICATION

This invention is useful in petroleum processing and in pilot plant and oil production operations.

It will be recognized that within the concepts of the combinational features above, considerable variation in the exact configuration of the components is permitted.

What is claimed is:

1. A coaxially aligned pumping machine comprising the combination of a fixed assembly and a moveable assembly; the fixed assembly comprising in combination at least one support means, a pump cylinder having means to permit inflow and outflow of fluid and a ballscrew, the ballscrew and cylinder being mounted by the support means coaxially with and spaced from each other proximate respective ends of the support means; and the moveable assembly comprising a drive mounted for reciprocal movement on the support means of the fixed assembly, a piston extending in one direction from the drive into the cylinder, the piston and cylinder comprising a pump, and a threaded shaft rotatably driven by the drive selective in two directions of rotation extending in the other direction from the drive through the ballscrew, the cylinder, piston, drive, shaft and ballscrew each having an axis and being coaxially aligned, the moveable assembly being so constructed and configured that when the drive rotates the shaft in one rotational direction, the moveable assembly moves in one reciprocal direction, and when the drive rotates the shaft in the other rotational direction, the moveable assembly moves in the other reciprocal direction to thereby cause the piston to reciprocate in the cylinder to pump fluid into and out of the cylinder.

2. The pumping machine of claim 1 wherein the drive comprises an electric drive motor and a harmonic drive gear assembly comprising a fixed/rigid circular spline having gears internally thereof, a moveable rigid circular spline having gears internally thereof, a flexible spline having gears externally thereof for meshing with the internal gears on the fixed and moveable rigid circular splines and a wave generator inside the flexible spline, the wave generator being rotatably driven by the drive motor in contact with the flexible spline for causing gears on portions only of the flexible spline to mesh with portions only of the gears of said rigid splines, said portions of gears moving circularly in the rigid splines as the wave generator is rotatably driven in one rotational direction or the other by the drive motor.

* * * * *